United States Patent [19]

Medeiros et al.

[11] 4,274,562

[45] Jun. 23, 1981

[54] SLIDABLE VALVE FOR DISPENSING FROM AN INSULATED BOTTLE

[75] Inventors: David E. Medeiros, Jewett City; Richard A. Tarozzi, Gales Ferry, both of Conn.

[73] Assignee: King-Seeley Thermos Co., Prospect Heights, Ill.

[21] Appl. No.: 68,000

[22] Filed: Aug. 20, 1979

[51] Int. Cl.[3] ..... B67D 5/42

[52] U.S. Cl. ..... 222/401; 137/614.12; 137/614.18; 222/131; 222/484; 222/522; 239/373; 251/353

[58] Field of Search ..... 222/131, 183, 209, 211, 222/383, 385, 399, 400.8, 401, 484, 485, 509, 561, 532, 531, 537, 522–525; 251/353; 137/614.12, 614.18; 239/337, 373, 583, 586

[56] References Cited

U.S. PATENT DOCUMENTS

| | | | |
|---|---|---|---|
| 346,761 | 9/1886 | Stebbins | 222/522 X |
| 1,964,362 | 6/1934 | Nassif | 222/401 X |
| 2,275,607 | 3/1942 | Bramming | 222/401 X |
| 2,405,681 | 8/1946 | Woock | 222/484 X |
| 2,463,152 | 3/1949 | Clark | 222/522 X |
| 2,555,459 | 6/1951 | Seufer | 222/561 |
| 2,631,763 | 3/1953 | Sutton | 222/522 |
| 2,851,066 | 9/1958 | Orr et al. | 222/522 X |
| 2,877,918 | 3/1959 | Gardner | 222/522 |
| 2,973,885 | 3/1961 | Ferguson | 222/399 |
| 3,905,520 | 9/1975 | Nislioka | 222/209 |

FOREIGN PATENT DOCUMENTS

| | | | |
|---|---|---|---|
| 777620 | 2/1968 | Canada | 222/531 |

*Primary Examiner*—F. J. Bartuska
*Assistant Examiner*—Fred A. Silverberg
*Attorney, Agent, or Firm*—Harness, Dickey & Pierce

[57] ABSTRACT

An insulated container having a pump for generating air pressure over the liquid in the container so as to selectively dispense it. A valve arrangement is incorporated that prevents inadvertent displacement of the liquid from the container if the pump is accidentally actuated. The valve arrangement prevents discharge of liquid from the discharge spout and also prevents the transmission of air pressure from the pump to the area in the container over the liquid.

9 Claims, 4 Drawing Figures

FIG. 2.
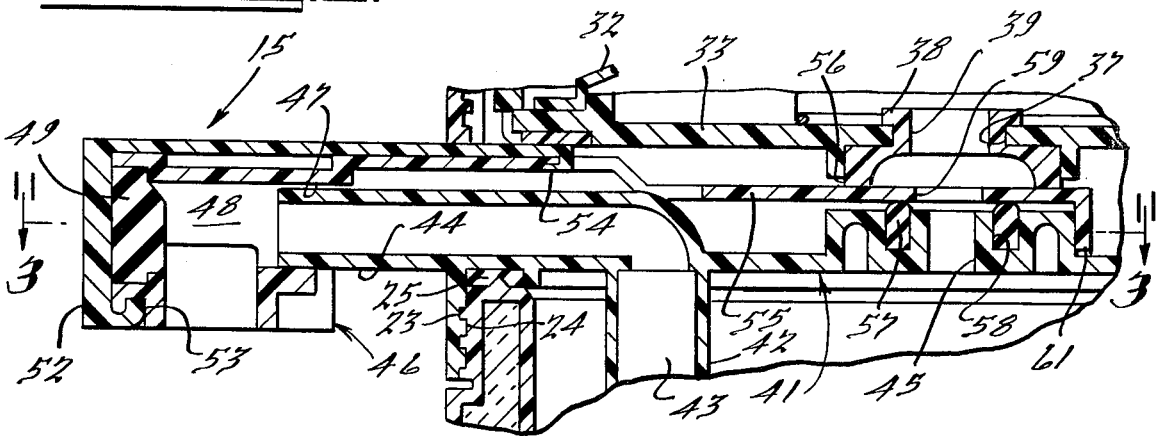
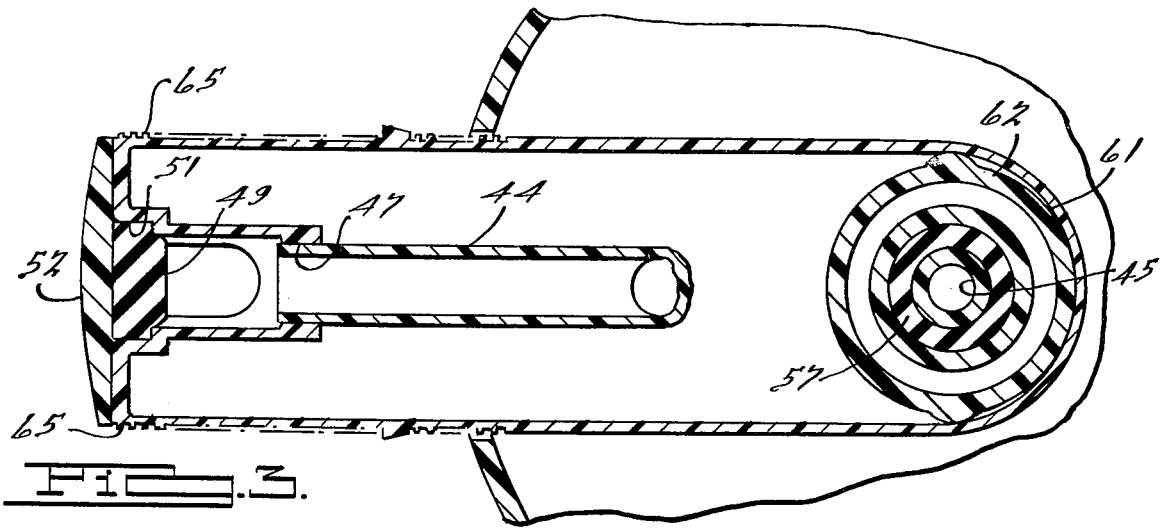
FIG. 3.
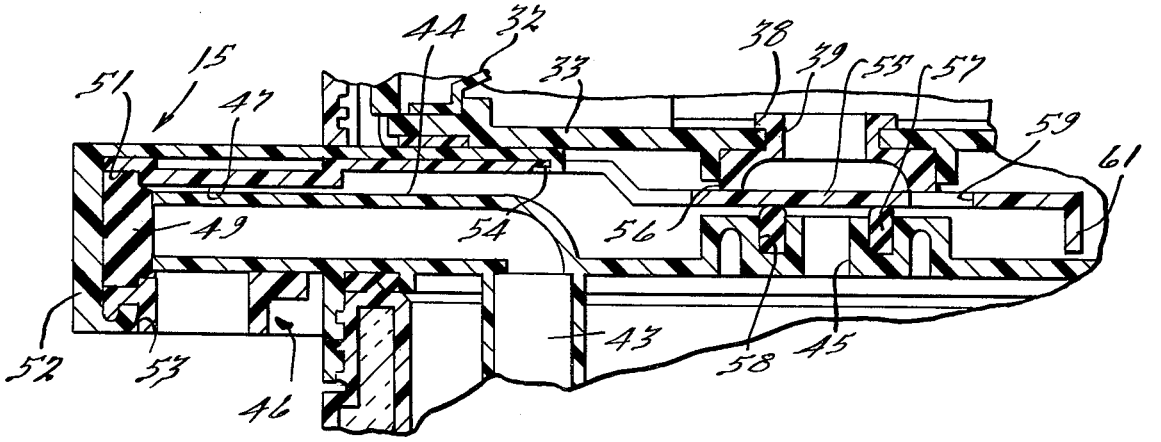
FIG. 4.

SLIDABLE VALVE FOR DISPENSING FROM AN INSULATED BOTTLE

BACKGROUND OF THE INVENTION

This invention relates to an insulated container and more particularly to an improved dispensing device for an insulated container.

Recently, it has been proposed to provide insulated containers with an air pump that generates air pressure over the liquid in the container for the purpose of dispensing. Such devices offer considerable convenience, but do have some disadvantages. It is desirable to position the actuator of the pump in such a location that it may be easily operated. However, this gives rise to the possibility of accidental actuation of the pump and discharge of liquid at an undesired time.

It is, therefore, a principal object of this invention to provide improved dispensing type insulated bottle.

It is another object of the invention to provide an improved arrangement for preventing accidental discharge of liquid from such a bottle.

Although the aforenoted advantages may be obtained by providing a valve in the liquid discharge system of the container, such arrangements as have heretofore been proposed for this purpose are complicated in construction and also do not effectively preclude the discharge of liquids. Furthermore, such arrangements may not successfully avoid internal leakage of the fluid in the event of accidental pump actuation.

It is, therefore, a still further object of this invention to provide an improved valve for a dispensing type insulated container.

SUMMARY OF THE INVENTION

A first feature of this invention is adapted to be embodied in a dispensing container having a body portion that defines a cavity for containing a liquid. Pump means are carried by the body portion and have an outlet port in communication with the cavity for generating a pressure upon the liquid therein upon operation of the pump means. Dispensing means deliver liquid from the cavity upon actuation of the pump. In accordance with this feature of the invention valve means are also provided that are movable between an open position and a closed position. The valve means are effective to simultaneously close communication of the outlet port with the cavity and to prevent liquid passing through the dispensing means when the valve means is in its closed position.

Another feature of the invention is adapted to be embodied in a dispensing container having a body portion pump and dispensing means as defined in the previous paragraph. In accordance with this feature of the invention, the dispensing means terminates in a discharge tube that extends through the body portion for delivery of the liquid from the cavity. A valve element is slidably supported by the body portion and encompasses at least in part the discharge tube. The valve element is slidable between an open position and a closed position and carries the sealing means adapted to engage and close the end of the discharge tube when the valve element is in its closed position.

Other objects, features, and advantages of the present invention will become apparent from the subsequent description and the appended claims, taken in conjunction with the accompanying drawings, in which:

BRIEF DESCRIPTION OF THE DRAWINGS

FIG. 2 is an enlarged cross sectional view of the container in FIG. 1 showing the construction of the dispensing valve;

FIG. 3 is a cross sectional view taken along the line 3—3 of FIG. 2;

FIG. 4 is a cross sectional view, in part similar to FIG. 2 showing the dispensing valve in its closed position.

DETAILED DESCRIPTION OF THE PREFERRED EMBODIMENT

Figure 1:
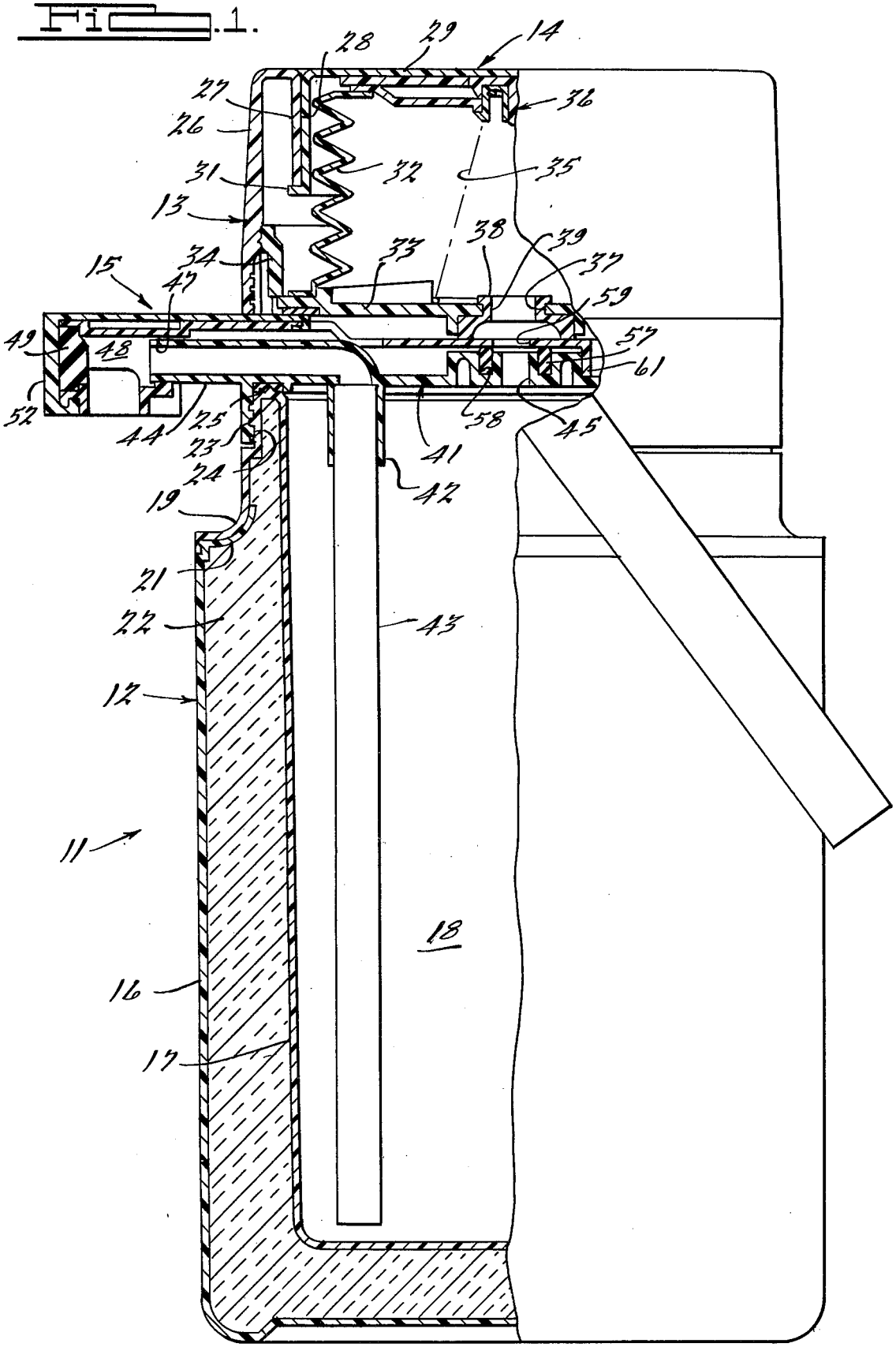
FIG. 1 is a side elevational view, in partial cross section of a dispensing container embodying this invention.

An insulated dispensing container embodying this invention is identified generally by the reference numeral 11. The container 11 includes a body portion, indicated generally by the reference numeral 12, a closure, indicated generally by the reference numeral 13, a pump assembly, indicated generally by the reference numeral 14 and a dispensing valve arrangement, indicated generally by the reference numeral 15. The valve arrangement 15 and its operation is shown in more detail in FIGS. 2 thru 4.

The body portion 12 is comprised of a double walled jacket consisting of an outer wall 16 and an inner wall 17 which defines an internal cavity 18. The walls 16 and 17 are connected at their upper end by means of overlapping portions 19 and 21 that are connected to each other by means of a snap fit, spin welding or the like. An insulating medium such as a foam plastic 22 is positioned in the area between the walls 16 and 17 so as to maintain the liquid in the cavity 18 at the desired temperature. Rather than the foam plastic 22 the space between the walls 16 and 17 may be filled with other types of insulations, such as a vacuum material.

The upper end of the body portion 17 is provided with male threads 23 so as to receive a female threaded portion 24 of the closure 13. A gasket 25 is positioned between a horizontal upper shoulder of the jacket 12 in the closure 13 so as to effect an air tight seal between these two components.

In order to provide for dispensing of liquid from within the cavity 18 the pump 14 selectively pressurizes the cavity 18 above the liquid level therein, as will become apparent.

The closure 13 includes an outer body 26 that has a re-entrant flange 27 which defines a cylindrical opening 28. A pump actuator in the form of an inverted cup 29 is slidably supported in the cavity 28. The pump actuator 29 has an outwardly extending flange 31 at its lower end which limits the degree of upward movement of the actuator 29.

The pump actuator 29 bears against the upper end of a bellows 32 which is contained between the pump actuator and a plate 33 that is contained within the closure member 13. The plate 33 has an upstanding portion 34 that is affixed in any known manner to outer housing 26. A conical compression spring 35 is contained within the bellows 32 and urges the bellows 32 to its distended position as shown in FIG. 1.

A check type valve, indicated by the reference numeral 36 is provided so as to selectively admit air into the interior of the bellows 32 on the return stroke of the pump 14. This air is introduced through the clearance between the cavity 28 and the pump actuator 29. The plate 33 has a central aperture 37 in which a sealing grommet 38 is positioned. The grommet 38, in turn, has a central opening 39 that permits communication between the interior of the bellows 32 and the area above the liquid in the container 18 so as to generate a pressure over this liquid when the pump actuator element 29 is depressed, as will become apparent.

The female threaded portion 24 of the closure 13 is formed in a plate assembly, indicated generally by the reference numeral 41 which forms the lower portion of the closure 13, the dispensing device and a portion of the valve 15. The plate 41 has a depending cylindrical portion 42 into which a dispensing tube 43 is pressed. The tube 43 extends to the lower portion of the cavity 18 so that it will be below the liquid in the cavity 18 until substantially all of the liquid has been expelled from this cavity. At the upper end of the cylindrical portion 42, a horizontally extending dispensing nozzle 44 is formed integrally with the plate 41. Thus, when the cavity 18 is pressurized above the liquid level therein liquid will be forced up through the tube 43 and cylindrical portion 42 for discharge through the nozzle 44.

The plate 41 has a central opening 45 that is aligned with the grommet opening 39 so as to permit air under pressure to flow into the cavity 18 when the pump 14 is actuated. The communication between the openings 39 and 45 and the discharge of the nozzle 44 are controlled by the valve arrangement 15, in a manner now to be described.

The valve arrangement 15 consists of an outer part 46 that defines a cylindrical opening 47 that is slidably received around the discharge nozzle 44. At the end of the cylindrical opening 47 a generally cylindrical downwardly extending cavity 48 is formed. The cavity 48 opens through the lower end of the portion 46 so that fluid dispensed from the nozzle 44 will be deflected in a generally downward direction when the valve arrangement 15 is in its opened position as shown in FIGS. 1 through 3.

An elastomeric seal 49 is positioned in an opening 51 formed at the outer end of the portion 46. The seal 49 is held in position by means of a cap piece 52 that is received over the sliding valve member which terminates in the portion 46. Inturned flanges 53 and 54 hold these two elements in place and capture the elastomeric seal 49 in its facing relationship to the outer end of the nozzle 44.

The sliding valve member has a generally horizontally extending portion 55 that extends inwardly toward the center of the container 11 and which is interposed between a sealing lip 56 formed at the lower end of the grommet 38 and a seal 57 that is received in a cylindrical cavity 58 of the plate 41. The sliding valve portion 55 is formed with an aperture 59 which is aligned with the grommet opening 39 and plate opening 45 when the valve arrangement 15 is in its dispensing position as shown in FIGS. 1 through 3. In this position, air may flow freely from the pump 14 into the cavity 18 through the aligned openings 39, 59 and 45. A downwardly extending cylindrical flange 61 cooperates with an upwardly extending cylindrical boss 62 of the plate 41 so as to limit the outward or dispensing movement of the sliding valve member.

The operation of the device will now be described. As has been noted, FIGS. 1 through 3 show it in its dispensing condition. In this condition the elastomeric seal 49 is spaced from the end of the discharge nozzle 44 and the cavity 48 of the sliding valve element will form a discharge opening. The aperture 59 of the sliding valve element also permits communication between the grommet opening 39 and plate opening 45.

When the pump actuator element 29 is depressed, the check valve 36 will close and the air trapped in the bellows 32 will be forced downwardly through the openings 39, 59 and 45 to increase the pressure in the cavity 18 above the liquid therein. This pressure difference will cause the liquid to be forced up through the tube 43 and out of the discharge nozzle 44. The liquid which is flowing horizontally out of the discharge nozzle 44 will be deflected downwardly through the cavity 48 into a container which the operator has positioned underneath the valve arrangement 15.

When the pump actuator element 29 is released, the spring 35 will urge the bellows 32 upwardly. The liquid in the cavity 18 over the end of the tube 43 will prevent reverse flow of liquid and air will be drawn into the interior of the bellows 32 through the now open check valve 36. A repeated depression of the pump actuator 29 will cause the successive dispension of liquid in the manner already described.

When it is desired not to have liquid dispensed and to prevent inadvertent displacement of liquid by accidental operation of the pump actuator 29, the valve assembly 15 is slid from the open position shown in FIGS. 1 thru 3 to its closed position (FIG. 4). This movement is facilitated by the formation of ridged surfaces 65 on the opposite sides of the valve assembly portion 46. When the valve assembly 15 is slid into its closed position, the elastomeric seal 49 will sealingly engage the outer end of the discharge nozzle 44 so as to prevent any liquid from flowing through this opening. This will be true even if the container 11 is inverted.

In addition to closing the nozzle 44, the valve assembly also prevents communication of the interior of the bellows 32 with the cavity 18. This prevents any air pressure from being built up in the cavity 18 if the pump actuator 29 is accidentally depressed and also precludes any liquid from flowing into the bellows 32 if the container 11 is inverted. As may be readily seen from FIG. 4, when the valve assembly 15 is in its closed position the aperture 59 will be out of registry with the openings 39 and 45. The seal 57 will contact the valve assembly portion 55 and prevent the flow of liquid back through the opening 45 into the bellows 32. At the same time, the lower edge 56 of the grommet 38 will sealingly engage the upper surface of the valve assembly portion 55 to provide the air seal.

It should be readily apparent from the foregoing description that a relatively simple yet highly effective valve mechanism is provided by this invention. This valve mechanism prevents inadvertent liquid displacement and also protects the interior of the pump from coming in contact with the liquid in the event the container is inverted. It is to be understood that various changes and modifications may be made without departing from the spirit and scope of the invention as defined by the appended claims.

What is claimed is:

1. In a dispensing container having a body portion defining a cavity for containing a liquid, pump means carried on the top of said body portion, said pump means having an outlet port in communication with said cavity for generating a pressure upon the liquid therein upon operation of said pump means, dispensing means extending laterally of the body portion and fixed relative thereto for delivering liquid from said cavity upon actuation of said pump means, the improvement comprising valve means movable between an opened position and a closed position, said valve means being effective to simultaneously close communication of said outlet port with said cavity and prevent liquid passage through said dispensing means when said valve means is in its closed position.

2. A container as set forth in claim 1 wherein the valve means comprises a first valve for closing the communication of the outlet port with the cavity and a second valve for precluding flow through the dispensing means, said first and said second valves being connected to a common actuator for simultaneous opening and closing thereof.

3. A container as set forth in claim 1 wherein the valve means is supported for reciprocating movement between its open and its closed positions.

4. A container as set forth in claim 1 wherein the means for preventing the liquid passing through the dispensing means comprises a seal carried by a portion of the valve means slidably supported around a horizontally extending portion of the dispensing means, said seal being engageable with the open end of said horizontally extending portion when said valve means is in its closed position and spaced therefrom when said valve means is in its opened position, said portion of said valve means defining a downwardly opening cavity through which liquid is dispensed when said valve means is in its opened position and the pump means is actuated.

5. A container as set forth in claim 1 wherein the outlet port is positioned in a lower surface of the pump means, there being a second opening disposed beneath and aligned with said outlet port, said valve means having an apertured part slidably positioned between said outlet port and said second opening, the aperture in said apertured part being aligned with said outlet port and said second opening when said valve means is in its opened position and non-aligned therein when said valve means is in its closed position for preventing communication between said outlet port and said second opening.

6. A container as set forth in claim 5 wherein the means for preventing the liquid passing through the dispensing means comprises a seal carried by a portion of the valve means slidably supported around a horizontally extending portion of the dispensing means, said seal being engageable with the open end of said horizontally extending portion when said valve means is in its closed position and spaced therefrom when said valve means is in its opened position, said portion of said valve means defining a downwardly opening cavity through which liquid is dispensed when said valve means is in its opened position and the pump means is actuated.

7. A dispensing container having a body portion defining a cavity for containing a liquid, pump means carried by said body portion, said pump means having an outlet port in communication with said cavity for generating a pressure upon the liquid therein upon operation of said pump means, dispensing means for delivering liquid from said cavity upon actuation of said pump means, said dispensing means terminating in a discharge tube extending through a side of said body portion and outwardly therefrom for delivery of the liquid from said cavity, a first valve element slidably supported on said body portion and extending around at least a part of said discharge tube, said first valve element being slidable between an opened position and a closed position, said first valve element carrying sealing means in facing relationship to the end of said discharge tube and adapted to engage and close the end of said discharge tube when said valve element is in the closed position, and a second valve element, said second valve element being moveable between an opened position in which said outlet port is in communication with said cavity and a closed position in which said outlet port is out of communication with said cavity, the first valve element and said second valve element being connected to a common actuator for simultaneous movement of said valve elements to their opened and closed positions.

8. A container as set forth in claim 7 wherein the second valve element comprises an apertured piece interposed between the outlet port and a part having an opening therein in communication with the cavity, seal means surrounding said outlet port and said opening for sealingly engaging opposite sides of said aperture piece.

9. A container as set forth in claim 7 or 8 wherein the discharge tube extends horizontally outwardly, the first valve element defining a downwardly extending opening adjacent said sealing means and through which liquid is discharged when said first valve element is in its opened position and said pump means is actuated.

* * * * *